US005609950A

United States Patent [19]

Kampl et al.

[11] Patent Number: 5,609,950

[45] Date of Patent: Mar. 11, 1997

[54] FLAME-RETARDANT NON-WOVEN TEXTILE ARTICLE AND METHOD OF MAKING

[75] Inventors: Reinhard Kampl; Walter Six, both of Vöcklabruck, Austria

[73] Assignee: Lenzing Aktiengesellschaft, Austria

[21] Appl. No.: 455,146

[22] Filed: May 31, 1995

[30] Foreign Application Priority Data

Nov. 7, 1994 [AT] Austria ..... 2058/94

[51] Int. Cl.[6] ..... D04H 1/08

[52] U.S. Cl. ..... 428/219; 28/104; 442/408; 442/414

[58] Field of Search ..... 428/280, 219, 428/288, 289; 28/104

[56] References Cited

U.S. PATENT DOCUMENTS

| | | | |
|---|---|---|---|
| 2,668,096 | 2/1954 | Reeves et al. . | |
| 2,701,244 | 2/1955 | Ham . | |
| 2,983,623 | 5/1961 | Coates et al. . | |
| 3,906,136 | 9/1975 | Weil . | |
| 3,969,268 | 7/1976 | Fukuda et al. . | |
| 4,040,843 | 8/1977 | Franko-Filipasic et al. . | |
| 4,063,883 | 12/1977 | Hupfl et al. | 8/116 P |
| 4,076,870 | 2/1978 | Yamamoto . | |
| 4,078,101 | 3/1978 | Cole . | |
| 4,145,463 | 3/1979 | Cole . | |
| 4,225,481 | 9/1980 | Wagner . | |
| 4,452,849 | 6/1984 | Nachbur et al. . | |
| 4,487,800 | 12/1984 | Nachbur et al. . | |
| 4,494,951 | 1/1985 | Cole et al. . | |
| 4,503,115 | 3/1985 | Hemels et al. . | |
| 4,780,359 | 10/1988 | Trask et al. . | |
| 4,938,901 | 7/1990 | Groitzsch et al. | 264/22 |
| 5,051,110 | 9/1991 | Borrell et al. . | |
| 5,114,786 | 5/1992 | Louis . | |
| 5,137,600 | 8/1992 | Barnes et al. . | |
| 5,235,541 | 8/1992 | Cole et al. . | |
| 5,253,397 | 10/1993 | Neveu et al. . | |

FOREIGN PATENT DOCUMENTS

| | | |
|---|---|---|
| 0285338 | 10/1988 | European Pat. Off. . |
| 0397947 | 11/1990 | European Pat. Off. . |
| 0447605 | 9/1991 | European Pat. Off. . |
| 0560629 | 9/1993 | European Pat. Off. . |
| 2280640 | 2/1976 | France . |
| 1289944 | 2/1969 | Germany . |
| 2532521 | 2/1976 | Germany . |
| 2622569 | 12/1976 | Germany . |
| WO9313249 | 7/1993 | WIPO . |
| WO9426962 | 11/1994 | WIPO . |

*Primary Examiner*—Christopher Raimund
*Attorney, Agent, or Firm*—Brumbaugh, Graves, Donohue & Raymond

[57] ABSTRACT

The invention refers to a flame-retardant non-woven textile article produced by bonding of a fleece without binder and is characterized in that the fleece contains cellulosic fibers in which at least one flame-retardant compound containing phosphorus is incorporated. The fleece is preferably bonded using water jets. The products according to the invention display excellent flame-retardation and good tear strength properties even with low area weights. The cellulosic fibers can be used either on their own or in blends with other fibers particularly high temperature resistant non-melting fibers. Compounds from the group of esters, esteramides and/or amides of pyrophosphoric acid from monothiono-, dithiono-, trithiophosphoric acid, triphosphoric acid, monothiono-, dithiono-, trithiono- and/or pentathiotriphosphoric acid or rather Bis-(2-oxo-1,3,2-dioxaphosphinanyl)-oxide, Bis-(2-thiono-1,3,2-dioxaphosphinanyl)-oxide or 2-oxo-1,3,2-dioxaphosphinanyl-2' thiono-1',3',2'-dioxaphosphinanyl-oxide are suitable as flame-retardant compounds containing phosphorus. Bis-(5,5-dimethyl-2-thiono-1,3,2-dioxa-phosphinanyl-oxide is particularly well suited.

21 Claims, No Drawings

FLAME-RETARDANT NON-WOVEN TEXTILE ARTICLE AND METHOD OF MAKING

BACKGROUND OF THE INVENTION

This invention concerns a flame-retardant non-woven textile article manufactured by bonding of fleece without a binder.

Flame-retardant woven textile articles are known from the literature. Usually, this entails treating a textile with one or more flame-retardant compounds. Substances containing phosphorus, in particular, have made a name for themselves in their capacity as flame-retardant compounds. Therefore, the treatment of cellulosic textile woven articles with flame-retardant compounds containing phosphorus has been described in numerous patent letters, such as the U.S. Pat. No. 5,135,541; U.S. Pat. No. 4,494,951; U.S. Pat. No. 4,487,800; U.S. Pat. No. 4,078,101 and U.S. Pat. No. 4,145,463.

What all these described procedures have in common is that the treatment with flame-retardant compounds is carried out on the textile after its manufacture.

Furthermore, it is known from the literature how flame-retardant non-woven textile articles may be manufactured. U.S. Pat. No. 3,906,136, for instance, describes a technique for producing flame-retardant textile articles by adding a derivate of hexahydrotriazinphosphonate to the textile, the phosphonate being subsequently cured to form a resin. This technique applies, among others, to non-woven cellulosic textile articles, too.

It is known from U.S. Pat. No. 2,983,623 that fibres and textiles can be treated with a mixture of tetrakis-hydroxymethyl-phosponiumchloride (THPC) and urea in the course of which a network-like polymer compound results in the textile article as a result of subsequent curing. The application of this technique to non-woven textile articles is mentioned.

With these known procedures, too, treatment using the flame-retardant compound containing phosphorus is carried out on the textile article after its manufacture. Additionally, a bonding always takes place because of the curing of the added compounds. In the context of manufacturing non-woven textile articles this process corresponds to bonding using binders or adhesive agents. This results in increased stiffness as well as a high area weight of the product which, in many fields of application, is not desired. Textiles which have been made flame-retardant in this way are also likely to release substances containing phosphorus while in use, producing unpleasant irritations to the skin. On top of that, the resin-producing substances applied pose a strain on the environment.

For all these reasons, the production of flame-retardant non-woven textile articles which are unaccompanied by the above-mentioned disadvantages and side effects has been attempted. In particular, efforts have been made to achieve bonding of the source material, namely the fleece, without adding additional substances.

EP 0 447 605 A1, for example, describes the manufacturing of a flame barrier with an area weight of 40 to 100 g/m2 made of a fleece by bonding the fleece using high-energy water jets, with the fleece textile consisting of partly graphitized polyacrylnitrile fibres.

The bonding of fleece using water jets has become known as "hydro-entanglement" or "spun-laced technology". The procedure entails the entanglement of the individual fibres of the fleece by means of water jets which are substantially directed in vertical manner onto the fleece under a certain pressure.

The disadvantage of the EP 0 447 605 A1 flame barrier is that polyacrylnitrile fibres are not biodegradable. Furthermore, the graphitizing of the polacrylnitrile fibres before their processing to the product involves one further costly process step. Furthermore, the black color of the evolving textile article which results from graphitizing makes the application of the article very difficult in many areas.

WO 93/13249 describes a process for the manufacture of a cellulosic product which contains polysilicic acid, the polysilicic acid being partly modified with aluminium silicate. Such products, and fibres in particular, are obtained by adding SiO2 to a solution of cellulose, such as viscose, in the form of polysilicic acid. This solution is then spun into fibres which incorporate chains of polysilicic acid. According to example 4 of this application, staple fibres produced in this way can be bonded to non-wovens using water jets.

The disadvantage of these known products is that the tenacity of the spun fibres, and therefore the tenacity of the products resulting from this technique, is low in comparison with fibres made by the usual viscose process. This means that these products do not lend themselves to certain specific fields of application.

SUMMARY OF THE INVENTION

It is therefore an object of this invention to produce a flame-retardant, non-woven textile article, which:

- with a cost-efficient, environmentally sound and simple production fulfils the requirements of a flame-retardant product;
- does not require additional binding agents, yet displays sufficient tenacity for the respective purpose even with low area weights;
- is not too stiff;
- does not cause any skin irritations and
- is, for the major part, bio-degradable.

These demands are met by a flame-retardant non-woven textile article produced by the binder-free bonding of a fleece, characterised in that the fleece contains cellulosic fibres which incorporate at least one flame-retardant compound containing phosphorus.

Surprisingly, it has been found that, in the case of the textile articles according to this invention, all the above requirements can be met while the disadvantages of the prior art can be avoided. Particularly striking is that, despite their simple manufacturing technique, the products made according to this invention are perfectly suited for various fields of application owing to their high flame resistance and tear strength.

By the application of cellulosic fibres which incorporate at least one flame-retardant compound containing phosphorus, it is meant, in the context of this invention, that the flame-retardant characteristic of fibres is not induced to the fibres when already being processed into a fabric or when being bonded to form a non-woven article, but that this characteristic is already present in the fibre before the bonding procedure e.g. when laying the fibre. Another important aspect is that the compound containing phosphorus is in fact incorporated in the fibres, and is not simply applied to the fibre surface. Through these measures it is guaranteed that the compounds will not come off when the product is used or washed out, and can, therefore, not lead to skin irritations or to reduced flame resistance.

BRIEF DESCRIPTION OF THE PREFERRED EMBODIMENTS

Techniques for the incorporation of flame-retardant compounds containing phosphorus in cellulosic fibres are known, in particular, from DE-OS 25 32 521 and DE-OS 26 22 569.

As a preference for the formation of the textile article, the fleece is bonded using water jets. It has been shown—quite unexpectedly—that hydro-entanglement, which can be considered an intensive washing process, does not in any way have a negative influence on the flame-retardation of the basic fibres. On the contrary: sufficiently flame-retardant products emerge also with low area weights.

In a preferred embodiment, the invented textile article displays an area weight of 30 to 120 g/m2, and preferably 50 to 80 g/m2. Products with such low area weights are very desirable, with respect to better wear comfort in particular. It is, however, surprising, that the invented products completely satisfy all other requirements, particularly with respect to flame-retardation, despite their area weight being so low.

In one further preferred embodiment, the fleece which is required for producing the textile article according to this invention and the textile article itself, substantially consists of the flame-retardant cellulosic fibres, i.e. the fleece does not contain any additions worth mentioning e.g. of other types of fibres.

Often, however, fabrics of blends of different fibre types are desired to meet special requirements so that, in one further preferred embodiment of this invention, the fleece and, therefore, the textile article according to this invention, are made of a blend of flame-retardant cellulosic fibres in combination with another fibre.

A very advantageous embodiment of the product of this invention consists of a blend of fibres characterised in that the other fibre is a non-melting high-temperature resistant fibre, such as a polyimide or polyaramide fibre. Such high-temperature resistant fibres are known and produce flame-retardant fabrics which satisfy very stringent demands when combined with flame-retardant cellulosic fibres.

One further advantageous embodiment of the textile article, which is the object of this invention, is characterised by its compliance with burning classification s-b according to DIN 66 083. This burning classification is the highest category to be obtained by cellulosic fibres and usually suffices for most areas of application for flame-retardant textiles. The demands made of textile articles in order to comply with burning classification s-b are shown in the next table:

| Burning time (s) | Glowing time (s) | Melting | Dripping | Rate of Decay (mm) |
|---|---|---|---|---|
| ≦2 | ≦25 | No | No | ≦150 |

As the, or at least as one of the flame-retardant compounds containing phosphorus which are incorporated in the cellulosic fibre and are correspondingly contained in the fleece and in the resultant textile article preferably esters, esteramides and/or amides of pyrophosphoric acid, of monothiono- dithiono-, trithiophosphoric acid, of triphosphoric acid, of monothiono-, dithiono-, trithiono- and/or pentathiotriphosphoric acid are used. Compounds of this kind and their application in cellulosic materials are known from DE-OS 26 22 569 and give the textile structure according to the invention particularly good flame-retardant properties.

In a further advantageous manner, the or at least one of the flame-retardant compounds containing phosphorus incorporated in the cellulosic fibres and correspondingly in the fleece and in the resultant textile article is/are a Bis-(2-oxo-1,3,2 dioxaphosphinanyl)-oxide or a Bis-(2-thiono-1,3,2-dioxaphosphinany)-oxide or a 2-oxo-1,3,2-dioxaphosphinanyl-2'thiono-1',3',2' dioxaphosphinanyl-oxide. Compounds of this kind and their use in cellulosic materials are known from DE-OS 25 32 521. Their application in textile articles according to this invention leads to products with excellent flame-protection properties.

In a particularly advantageous way, Bis-(5,5-dimethyl-2-thiono-1,3,2-dioxa-phosphinanyl)-oxide is used. This compound is sold under the tradename SANDOFLAM by SANDOZ AG and produces excellent values when used in the textile articles which are the object of this invention.

Preferred embodiments of the invention are described in more detail in the following, whereby it should be pointed out that the examples only represent a small selection of the different possible embodiments of this invention and should not, therefore, restrict the object of this invention in any way.

EXAMPLE 1

Production of a Flame-retardant Non-woven Textile Article with an Area Weight of 50 g/m2

The starting material for the test was fibres made of 100% Viscose FR. Viscose FR is a flame-retardant viscose fibre produced by Lenzing AG with incorporated flame-retardant compounds containing phosphorus as described in DE-OS 25 32 521.

The fibre data used for the fibres in the test made of Viscose FR is as follows:

Titre: 1.7 dtex

Cut length: 40 mm

Tenacity cond.: 24 cN/tex

Elongation cond. 15%

Tenacity wet: 12 cN/tex

Wet Modulus: 3 cN/tex

The fibres display a limited oxygen limit (LOI) of 28%.

The fibres were aerodynamically laid into a random fleece in the usual manner and were finally bonded on a conventional apparatus for hydroentanglement. The fleece was passed through the apparatus three times altogether whereby water jets sprayed in vertical fashion onto the web with different pressures in four different sections (table 2):

TABLE 2

| Passage No. | Section 1 (MPa) | Section 2 (MPa) | Section 3 (MPa) | Section 4 (MPa) |
|---|---|---|---|---|
| 1 | 0.5 | 4 | 7 | 6 |
| 2 | 4 | 5 | 7 | 4 |
| 3 | 4 | 5 | 7 | 4 |

The resultant non-woven textile structure was dried on a drying stenter at a temperature of 100° C and a speed of 5 m/min.

In this way, 100 m of the textile structure as described in this invention, were produced with an area weight of approx. 50 g/m2.

EXAMPLE 2

Production of a Flame-retardant Now-woven Textile Article with an Area Weight of 60 g/m2.

With the same starting material and according to a process equivalent to example 1, 100 m of a textile article according to the invention were produced with an area weight of approx. 60 g/m2.

The following pressures were recorded when passing through the different sections in the apparatus for hydroentanglement (table 3):

| Passage No. | Section 1 (MPa) | Section 2 (MPa) | Section 3 (MPa) | Section 4 (MPa) |
|---|---|---|---|---|
| 1 | 0.5 | 5 | 7 | 9 |
| 2 | 4.5 | 6 | 8 | 6 |
| 3 | 4.5 | 6 | 8 | 6 |

EXAMPLE 3

Production of a Flame-retardant Non-woven Textile Article with an Area Weight of 80 g/m2.

With the same starting material and according to a process equivalent to example 1, 100 m of a textile article according to the invention were produced with an area weight of approx. 80 g/m2.

The following pressures were recorded when passing through the different sections in the apparatus for hydroentanglement (table 4):

TABLE 4

| Passage No. | Section 1 (MPa) | Section 2 (MPa) | Section 3 (MPa) | Section 4 (MPa) |
|---|---|---|---|---|
| 1 | 0.5 | 6 | 8 | 9 |
| 2 | 3 | 7 | 8 | 6 |
| 3 | 6.5 | 7 | 8 | 6 |

PROPERTIES OF THE INVENTED TEXTILE STRUCTURE AND COMPARISON USING A COMPARATIVE TRIAL

The table which follows (table 5) lists the properties of the textile articles of the invention produced according to examples 1–3 and the properties of a non-woven textile article produced via a comparative trial.

In this comparative trial, samples were produced according to the conditions of example 2, however, non flame-retardant standard viscose fibres were taken as the starting material.

TABLE 4

| | | Example 1 | Example 2 | Example 3 | Comparative Example |
|---|---|---|---|---|---|
| Area weight | g/m2 | 56.05 | 64.40 | 79.25 | 63.58 |
| Thickness | mm | 0.513 | 0.513 | 0.596 | 0.698 |
| Tear Strength longitud. | | 55.10 | 70.70 | 82.70 | 70.50 |
| Tear Strength traverse. | N | 31.90 | 39.80 | 55.80 | 52.20 |
| Elongation longt. | % | 31.00 | 30.10 | 32.60 | 30.10 |
| Elongation traverse | | 70.50 | 67.00 | 69.90 | 62.30 |

The tear strength refers to a piece of the respective textile structure with a width of 5 cm.

As can be clearly seen from table 4, there is no significant loss in tenacity compared to conventional non flame-retardant articles in the textile articles contained in this invention despite the use of flame-retardant substances. This becomes clear, in particular, when comparing the properties of the article according to example 2 with those of the sample from the comparative trial, which have about the same area weight.

The burning category of the three textile articles of the invention, manufactured according to examples 1 to 3 was determined according to DIN 66 083. All three products according to this invention satisfy burning classification s-b of this standard despite their low area weight.

This burning category is only reached by woven textile structures as of an area weight of at least approx. 150 g/m2.

We claim:

1. A flame-retardant non-woven textile article prepared by the process of bonding by hydroentanglement a fleece comprising cellulosic fibers incorporating at least one phosphorous containing flame-retardant compound, the area weight of said textile article being 30 to 120 g/m$^2$.

2. A flame-retardant non-woven textile article according to claim 1 wherein the area weight of the textile article is 50 to 80 g/m$^2$.

3. A flame-retardant non-woven textile article according to claims 1 or 2 wherein the phosphorous containing flame retardant compound is selected from the group consisting of phosphoric ester, esteramide of phosphoric acid, amide of phosphoric acid, ester of pyrophosphoric acid, esteramide of pyrophosphoric acid, amide of pyrophosphoric acid, ester of monothionophosphoric acid, esteramide of monothionophosphoric acid, amide of monothionophosphoric acid, ester of dithionophosphoric acid, esteramide of dithionophosphoric acid, amide of dithionophosphoric acid, ester of trithiophosphoric acid, esteramide of trithiophosphoric acid, amide of trithiophosphoric acid, ester of triphosphoric acid, esteramide of triphosphoric acid, amide of triphosphoric acid, ester of monothionotriphosphoric acid, esteramide of monothionotriphosphoric acid, amide of monothionotriphosphoric acid, ester of dithionotriphosphoric acid, esteramide of dithionotriphosphoric acid, amide of dithionotriphosphoric acid, ester of trithionotriphosphoric acid, esteramide of trithionotriphosphoric acid, amide of trithionotriphosphoric acid, ester of pentathiotriphosphoric acid, esteramide of pentathiotriphosphoric acid, amide of pentathiotriphosphoric acid, and combinations thereof.

4. A flame-retardant non-woven textile article according to claims 1 or 2 wherein the phosphorous containing flame retardant compound is selected from the group consisting of a Bis (2-oxo-1,3,2-dioxaphosphinanyl)-oxide, a Bis (2-thiono-1,3,2-dioxaphosphinanyl)-oxide, and a 2-oxo-1,3,2-dioxaphosphinanyl-2'-thiono-1',3',2'-dioxaphosphinanyl-oxide.

5. A flame-retardant non-woven textile article according to claim 4 wherein the phosphorous containing flame-retardant is Bis (5,5 dimethyl-2-thiono-1,3,2 dioxaphosphinanyl)-oxide.

6. A flame-retardant non-woven textile article according to claims 1 or 2 wherein the non-woven textile article exhibits the properties required for an s-b burning classification according to DIN 66 083.

7. A flame-retardant non-woven textile article prepared by the process of bonding a fleece comprising a blend of cellulosic fibres and at least one other fibre, said cellulosic fibres incorporating at least one phosphorous containing flame-retardant compound.

8. A flame-retardant non-woven textile article according to claim 7 wherein the other fibre is a non-melting high temperature resistant fibre.

9. A flame-retardant non-woven textile article according to claim 8 wherein the other fibre is selected from the group consisting of polyimide and polyaramide.

10. A flame-retardant non-woven textile article according to claim 7 wherein the fleece is bonded by hydroentanglement.

11. A flame-retardant non-woven textile article according to claim 7 or 10 wherein the area weight of the textile article is 30 to 120 g/m$^2$.

12. A flame-retardant non-woven textile article according to claim 7 or 10 wherein the area weight of the textile article is 50 to 80 g/m$^2$.

13. A method of preparing a flame-retardant non-woven textile article comprising the steps of:

providing a fleece comprising cellulosic fibres incorporating at least one phosphorous containing flame-retardant compound;

directing water jets onto the fleece in a substantially vertical direction to the fleece; and entangling the individual fibres of the fleece thereby forming a flame-retardant non-woven textile article wherein the textile article has an area weight of 30 to 120 g/m$^2$.

14. A method of preparing a flame-retardant non-woven textile article according to claim 13 wherein the area weight of the textile article is 50 to 80 g/m$^2$.

15. A method of preparing a flame-retardant non-woven textile article according to claims 13 or 14 wherein the fleece comprises a blend of cellulosic fibres and at least one other fibre.

16. A method of preparing a flame-retardant non-woven textile article according to claim 15 wherein the other fibre is a non-melting high temperature resistant fibre.

17. A method of preparing a flame-retardant non-woven textile article according to claim 16 wherein the other fibre is selected from the group consisting of polyimide and polyaramide.

18. A method of preparing a flame-retardant non-woven textile article according to claims 13 or 14 wherein the phosphorous containing flame retardant compound is selected from the group consisting of phosphoric ester, esteramide of phosphoric acid, amide of phosphoric acid, ester of pyrophosphoric acid, esteramide of pyrophosphoric acid, amide of pyrophosphoric acid, ester of monothionophosphoric acid, esteramide of monothionophosphoric acid, amide of monothionophosphoric acid, ester of dithionophosphoric acid, esteramide of dithionophosphoric acid, amide of dithionophosphoric acid, ester of trithiophosphoric acid, esteramide of trithiophosphoric acid, amide of trithiophosphoric acid, ester of triphosphoric acid, esteramide of triphosphoric acid, amide of triphosphoric acid, ester of monothionotriphosphoric acid, esteramide of monothionotriphosphoric acid, amide of monothionotriphosphoric acid, ester of dithionotriphosphoric acid, esteramide of dithionotriphosphoric acid, amide of dithionotriphosphoric acid, ester of trithionotriphosphoric acid, esteramide of trithionotriphosphoric acid, amide of trithionotriphosphoric acid, ester of pentathiotriphosphoric acid, esteramide of pentathiotriphosphoric acid, amide of pentathiotriphosphoric acid, and combinations thereof.

19. A method of preparing a flame-retardant non-woven textile article according to claims 13 or 14 wherein the phosphorous containing flame retardant compound is selected from the group consisting of a Bis (2-oxo-1,3,2-dioxaphosphinanyl)-oxide, a Bis (2-thiono-1,3,2-dioxaphosphinanyl)-oxide, and a 2-oxo-1,3,2-dioxaphosphinanyl-2'-thiono-1',3',2'-dioxaphosphinanyl-oxide.

20. A method of preparing a flame-retardant non-woven textile article according to claim 19 wherein the phosphorous containing flame-retardant is Bis (5,5 dimethyl-2-thiono-1,3,2 dioxa-phosphinanyl)-oxide.

21. A method of preparing a flame-retardant non-woven textile article according to claims 13 or 14 wherein the non-woven textile article exhibits the properties required for an s-b burning classification according to DIN 66 083.

* * * * *